US008356760B2

(12) United States Patent
Riley, Jr.

(10) Patent No.: US 8,356,760 B2
(45) Date of Patent: Jan. 22, 2013

(54) APPARENT TEMPERATURE CONTROLLER

(76) Inventor: Claude Roger Riley, Jr., Knoxville, TN (US)

( * ) Notice: Subject to any disclaimer, the term of this patent is extended or adjusted under 35 U.S.C. 154(b) by 408 days.

(21) Appl. No.: 12/386,009

(22) Filed: Apr. 13, 2009

(65) Prior Publication Data

US 2011/0168792 A1 Jul. 14, 2011

Related U.S. Application Data

(60) Provisional application No. 61/124,436, filed on Apr. 17, 2008.

(51) Int. Cl.
*F24F 3/14* (2006.01)
*G05D 22/00* (2006.01)
*G05D 23/00* (2006.01)

(52) U.S. Cl. ..... 236/44 C; 236/91 D; 62/176.6

(58) Field of Classification Search ..... 236/1 C, 236/44 C, 91 D, 94; 62/176.6
See application file for complete search history.

(56) References Cited

U.S. PATENT DOCUMENTS

| | | | | | |
|---|---|---|---|---|---|
| 4,873,649 | A * | 10/1989 | Grald et al. | ..... | 700/276 |
| 5,303,561 | A * | 4/1994 | Bahel et al. | ..... | 62/186 |
| 5,737,934 | A * | 4/1998 | Shah | ..... | 62/176.6 |
| 6,557,771 | B2 * | 5/2003 | Shah | ..... | 236/44 C |
| 6,892,547 | B2 * | 5/2005 | Strand | ..... | 62/176.6 |
| 2007/0084937 | A1 * | 4/2007 | Ahmed | ..... | 236/44 C |

* cited by examiner

*Primary Examiner* — Marc Norman
(74) *Attorney, Agent, or Firm* — Pitts & Lake, P.C.

(57) ABSTRACT

A HVAC control system is described that utilizes either a look-up table or an equation to calculate an apparent temperature based on the temperature and the moisture in the air at the control point. As the control system operates, the target temperature is constantly modified based on the current temperature and humidity or equivalently the calculated moisture in the air to maintain a constant apparent temperature. This has the effect of reducing the variance in the perceived comfort in the controlled area. An important additional feature is the cost savings due to reduced energy usage that is possible when external relative humidity conditions change so that less cooling or heating is required to maintain a comfortable environment.

3 Claims, 10 Drawing Sheets
(10 of 10 Drawing Sheet(s) Filed in Color)

APPARENT TEMPERATURE CONTROLLER

BACKGROUND OF THE INVENTION

All warm-blooded animals maintain a consistent body temperature. When heat loss from the body is excessive, some source of heat must be supplied for the body temperature to be maintained. When no other source of heat is available, the body tends to shiver in an attempt to provide heat through muscular activity. When the body temperature is excessive, some heat must be removed to maintain proper body temperature.

Typical mechanisms for removal of heat from an inert object are conduction, radiation and convection. These are also operational in the case of living objects. Conduction is apparent when you stand on a cold tile floor in your bare feet. Radiation is typically a poor mechanism in this case since the temperature differentials are relatively small. Convection is apparent when a breeze is present. However, the major mechanism in the case of living objects is evaporation. An amount of energy, known as the latent heat of evaporation, must be supplied when water changes from a liquid state to a vapor state. This is approximately 540 Calories per gram. This mechanism is seen in trees as water evaporates from the surface of the leaves. Since there are many leaves on a large tree, this evaporation is equivalent to several tons of air conditioning for this single large tree and is one reason that a forest feels cooler than an adjacent field.

The primarily mechanism for the cooling of animals is evaporative cooling. The sweat glands in the human body produce sweat, a watery fluid containing sodium chloride and urea, when it is overheated. The eccrine sweat glands are distributed over the entire body but are particularly abundant on the hands, soles of the feet and on the forehead. Apocrine sweat glands are mainly found in the armpits and genital area and also contain fatty material. It is the breakdown of this fatty material that is the primary cause of sweat odor. The vaporization of this moisture removes thermal energy from the body. This is also the primary mechanism for dogs. However, they have few sweat glands and most of the evaporation is from the moist lining of the oral cavity and pharynx. This results in their panting behavior.

The water present on the skin is in equilibrium with the water vapor in the air. Thus, the efficiency of this sweating mechanism depends on the amount of water vapor in the air. Thus we cool off rapidly on dry days but very slowly on humid days. This is also part of the reason why a breeze helps to cool us off—it not only increases the convective cooling but also reduces the higher concentration of moisture around the body. The perceived comfort level in any given atmosphere is related not only to the temperature but also to the efficiency of the evaporative cooling and thus the relative humidity.

The relationship between vapor pressure of water in air versus temperature is shown in FIG. 1 along with a cubic equation that provides an excellent fit over the temperature range shown. This is also includes the normal operating range of most HVAC installations. It is an easy calculation to find the change in relative humidity for a change in temperature when the moisture in the air is held constant. Table 1 shows that for a change of +/−3° C. the relative humidity changes by −/+10% to 15%. Thus, if we were simply cooling the air, the temperature would decrease but the humidity would increase. This would result in a lessened change in perceived comfort. Fortunately in this case, air conditioning systems also remove moisture from the air resulting in a perceived improvement in cooling.

Table 2 gives the moisture in the air as at different temperatures and relative humidifies as a percentage of the moisture at 20° C. and 65% relative humidity. Indeed, if we have a room with constant temperature but a gradient in the relative humidity, our perception is that the room cools off as we walk from the area of high humidity towards the end with lower humidity.

The basic concept for controlling a HVAC system has been to provide a thermostat that turns on the system when an upper set point is exceeded when air conditioning is required. When heat is required, a lower control point is utilized. An improvement is seen in several patents issued for HVAC control systems that are based on a comfort system whereby the control system attempts to adjust the set point temperature based on selected environmental variables including air temperature, humidity, air velocity, clothing insulation, bodily heat production and mean radiant temperature. All of these suffer from the same problems:

- They require a large amount of computing power and are slow, iterative calculations poorly adaptive to a control system.
- They require feedback from the room occupant as a means of training the system.
- They involve complicated variables that actually are relatively constant, at least for a given installation over a long period of time.
- The concept of a comfort index is alien to the average homeowner.
- They attempt to calculate the dehumidification effects of the HVAC system rather than simply measuring it.

What is needed then is a simple to understand and use control system that can be implemented in an inexpensive microcomputer.

BRIEF SUMMARY OF INVENTION

The patent or application file contains at least one drawing executed in color. Copies of this patent or patent application publication with color drawing(s) will be provided by the Office upon request and payment of the necessary fee.

One method of dealing with the last problem is to utilize a parameter similar to one well known to everyone that has watched or listened to a weather forecast—the heat index. The heat index is usually announced along the temperature during the summer. This is the temperature that it "feels like" given the relative humidity and assuming standard clothing and wind conditions.

The heat index is based on work published by R. G. Steadman. Excerpts of these tables as they apply to outdoor summer weather conditions may be found on the NOAA web site (www.nws.noaa.gov). Several authors report a multiple regression fitting of Steadman's data and refer to the equation as the Heat Index Equation.

$$HI=-42.379+2.04901523*T+10.14333127*R-0.22475541*T*R-6.83783\times10^{-3}*T^2-5.481717*10^{-2}*R^2+1.22874\times10^{-3}T^2R-1.99\times10^{-6}*T^2R^2$$

where T is the temperature in ° F. and R is the relative humidity in percent. A graph of this equation is shown in FIG. 2 for several different relative humidities. Note that all of the curves converge at approximately 77° F. Even more important, the order of the curves is inverted below this temperature. Since this is directly in the middle of the normal HVAC control range, it should be apparent that this equation is useless for a HVAC control system.

A more comprehensive set of data reported by Steadman is shown in FIG. 3 with different curves plotted for different relative humidities. Unfortunately, the measurements do not cover the HVAC control range (they stop at 20° C. or 68° F.) and do not provide a predictable continuous function required by a control system. The only comparable parameter for lower temperatures is the wind chill factor, also reported by the weather forecast in the winter. Unfortunately, this only reflects the removal of heat from the body by varying wind speeds and does not apply in this situation. What is needed then is a function that is easily calculated, provides a converging solution through the complete HVAC control range and does not require any training by the consumer.

BRIEF DESCRIPTION OF THE DRAWINGS

The patent or application file contains at least one drawing executed in color. Copies of this patent or patent application publication with color drawing(s) will be provided by the Office upon request and payment of the necessary fee. Due to the complex nature of the graphs, color is required to present multiple functions on the same graph.

Table 1: The relative humidity at different temperatures when the moisture in the air is held constant.

Table 2: The moisture in the air at different temperatures and relative humidifies as a percentage of moisture at in the air at 20° C. and 65% R.H.

Figure 1:
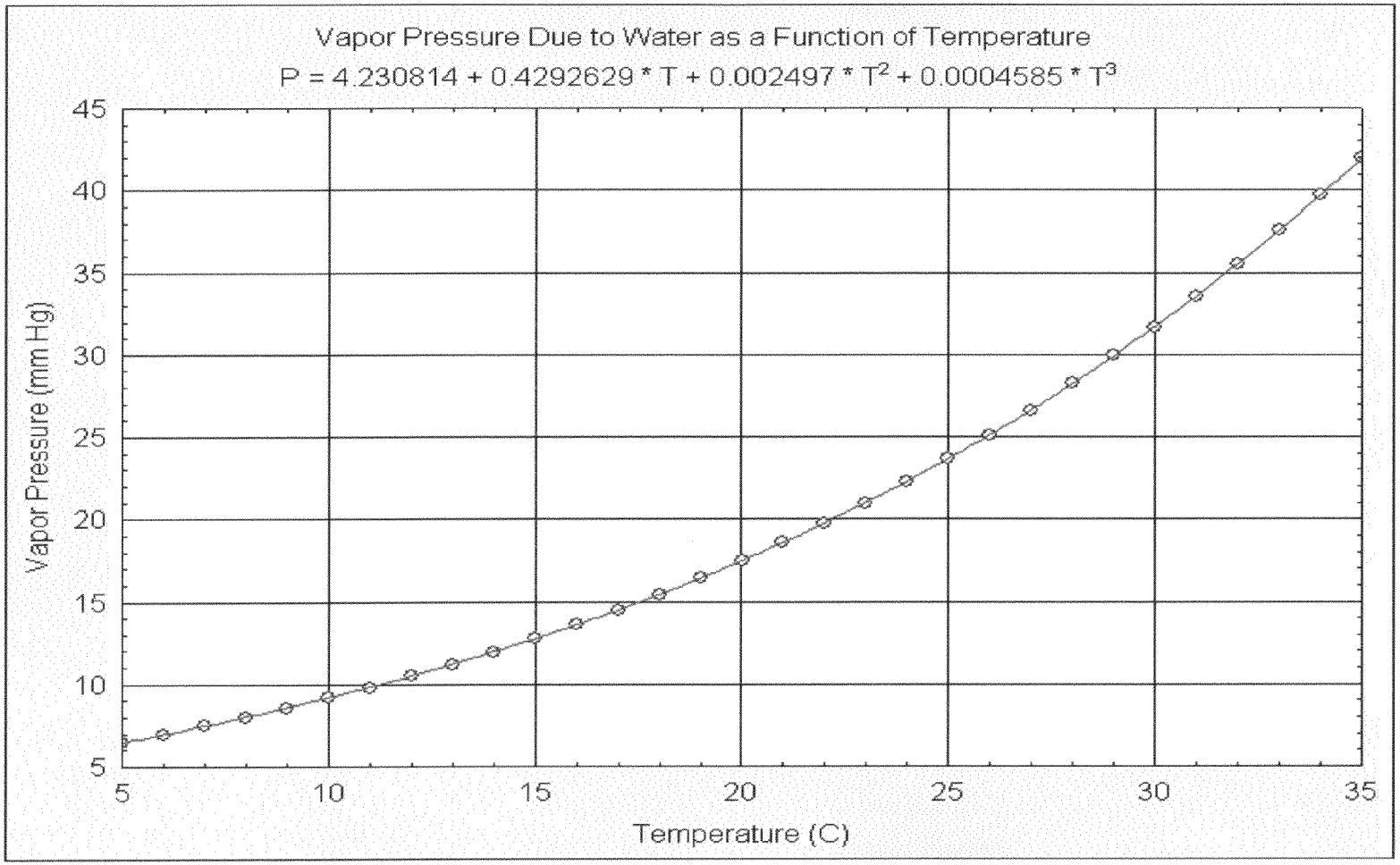

FIG. 1: Moisture in Air vs. Temperature.

Figure 2:
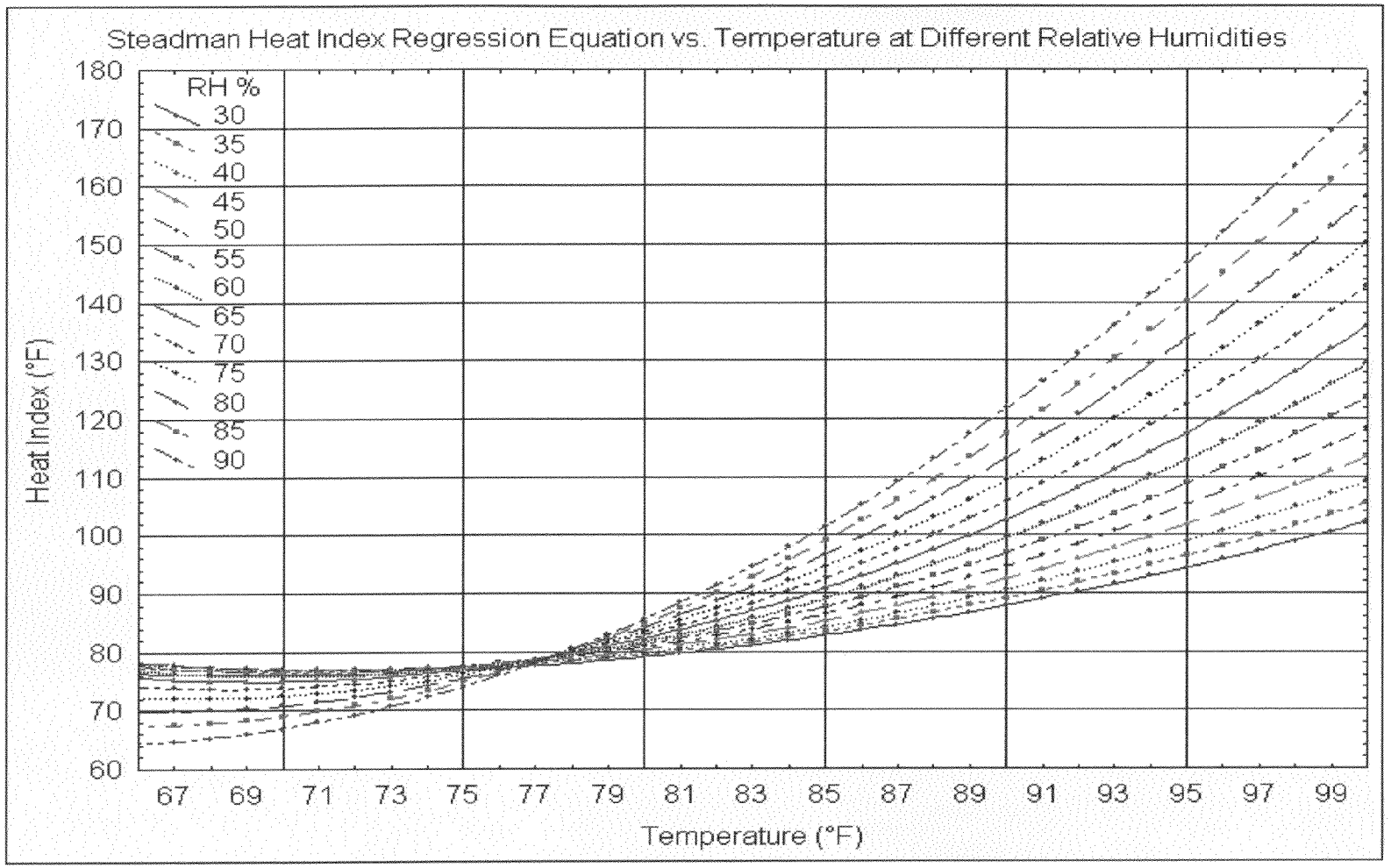

FIG. 2: Steadman Heat Index regression equation.

Figure 3:
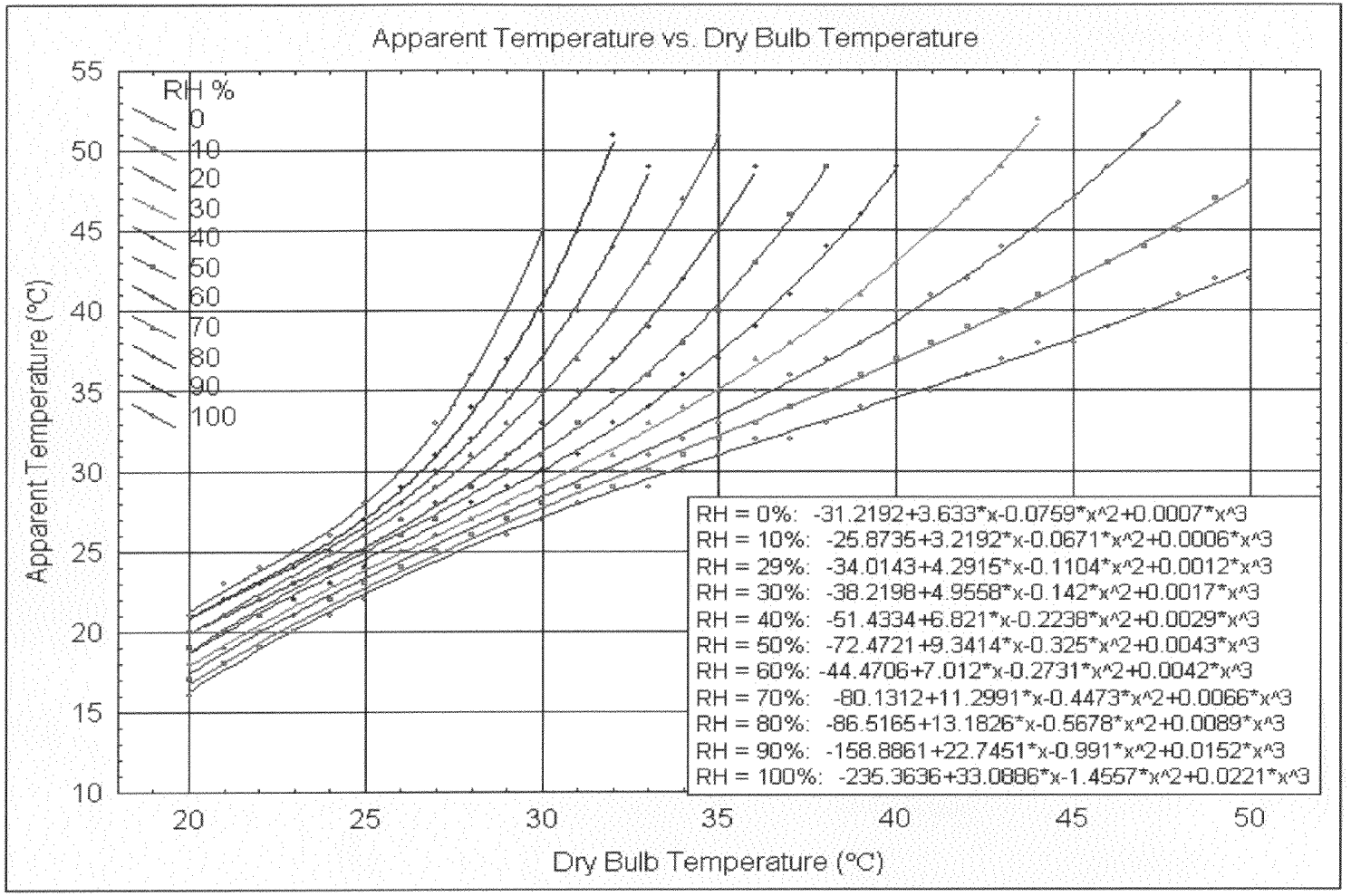

FIG. 3: Apparent Temperature vs. Dry Bulb Temperature.

Figure 4:
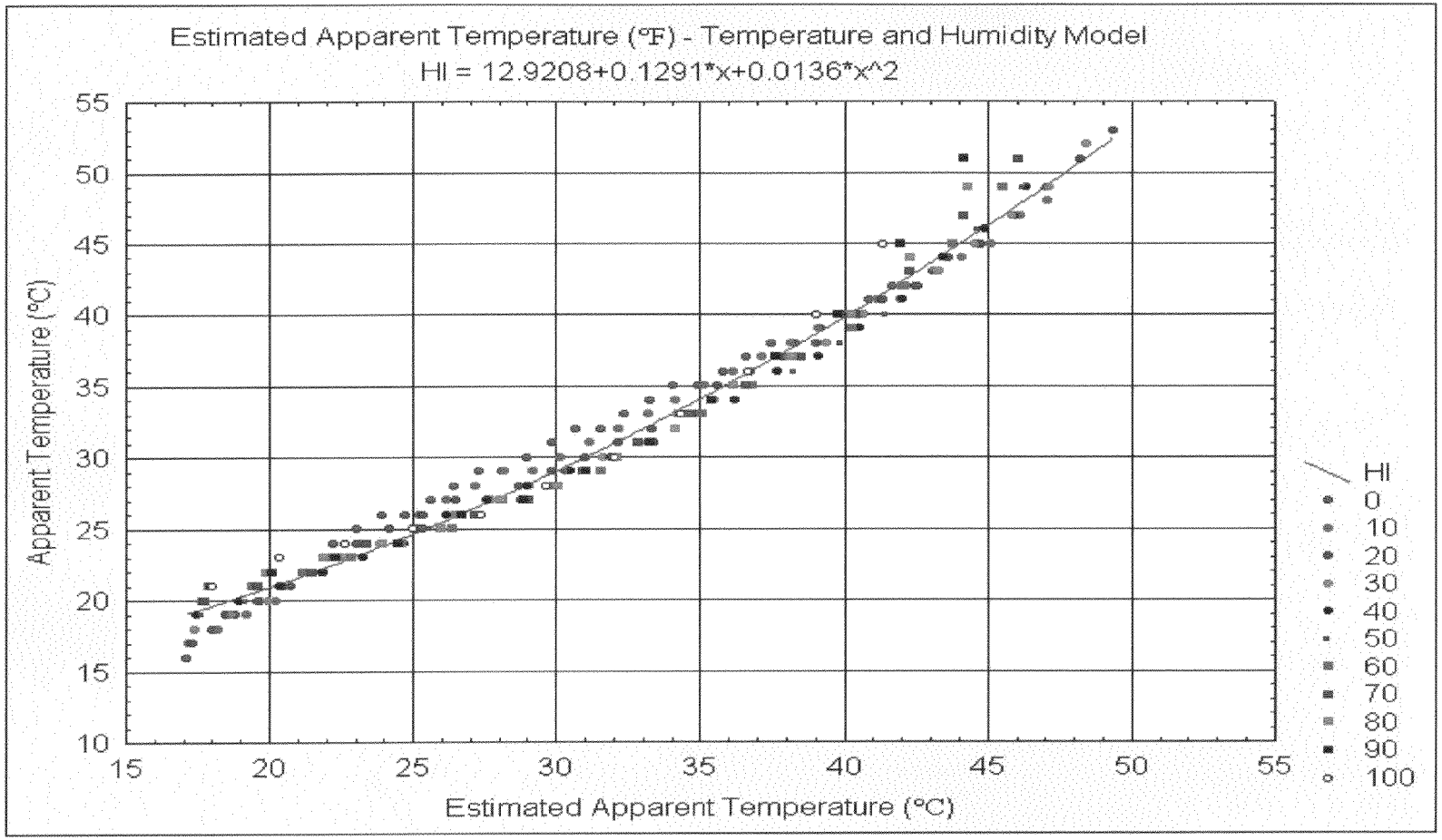

FIG. 4: Estimated Apparent Temperature from temperature and humidity model.

Figure 5:
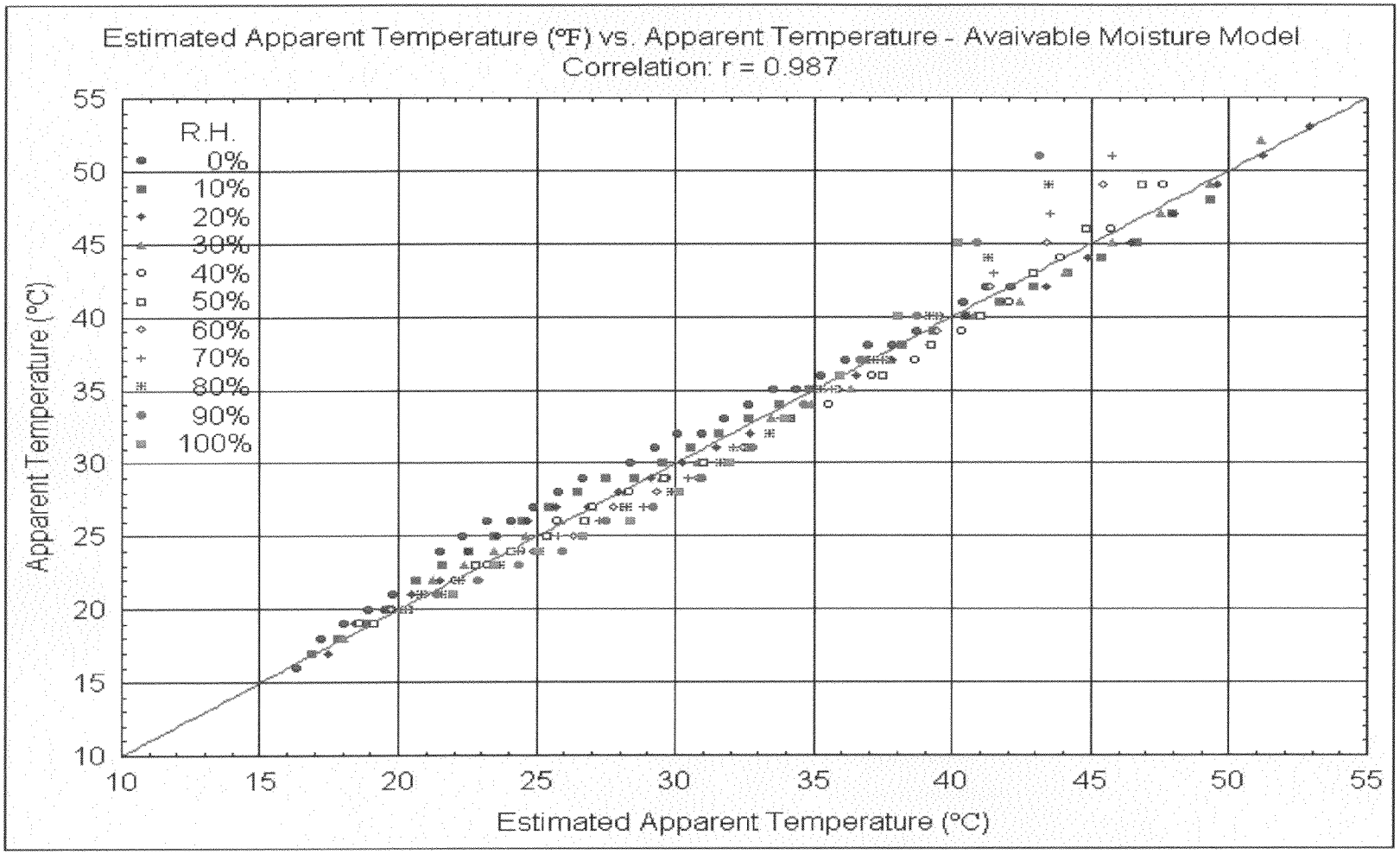

FIG. 5: Estimated Apparent Temperature using available moisture model.

Figure 6:
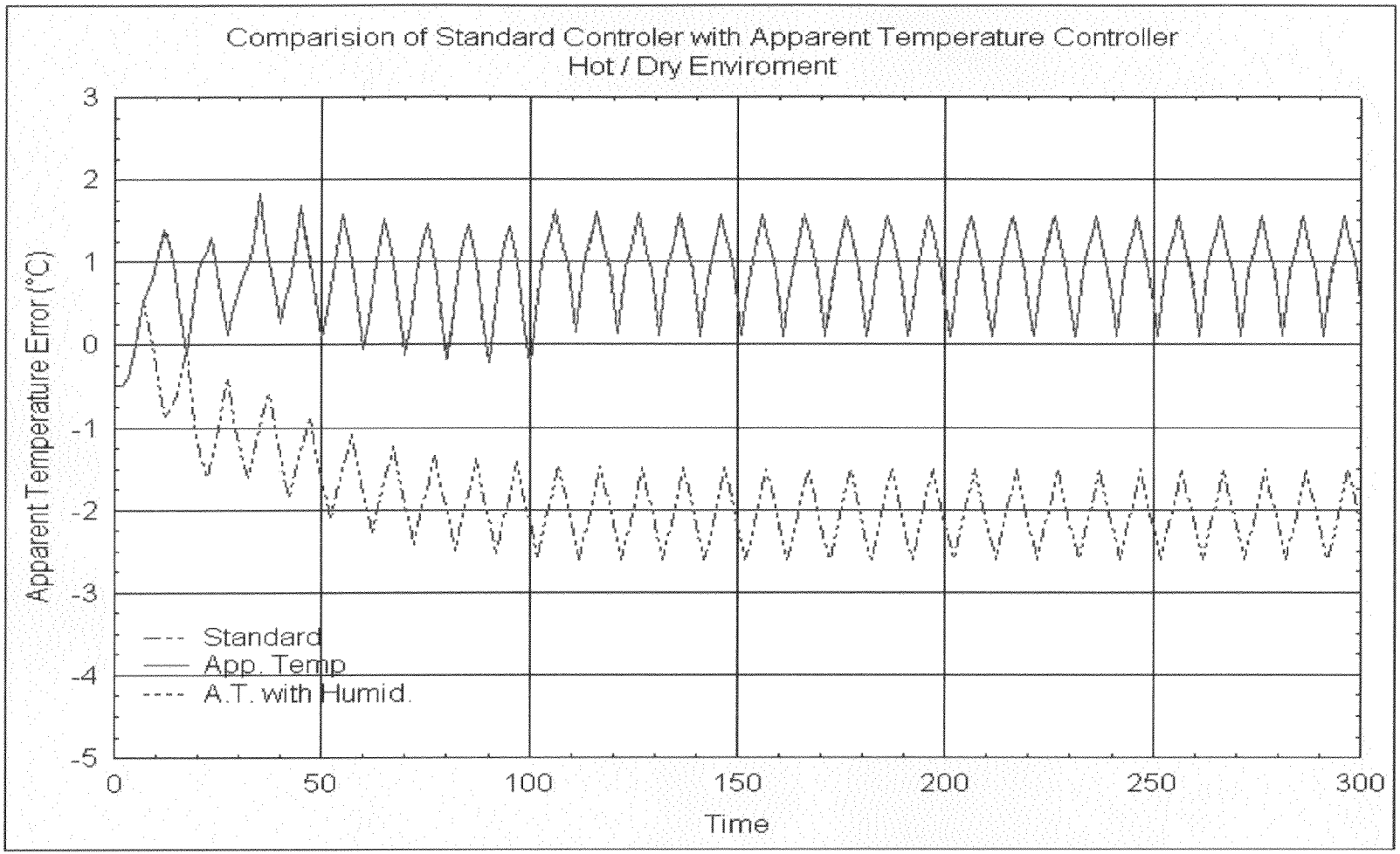

FIG. 6: Comparison of standard controller with apparent temperature controller for a hot/dry environment.

Figure 7:
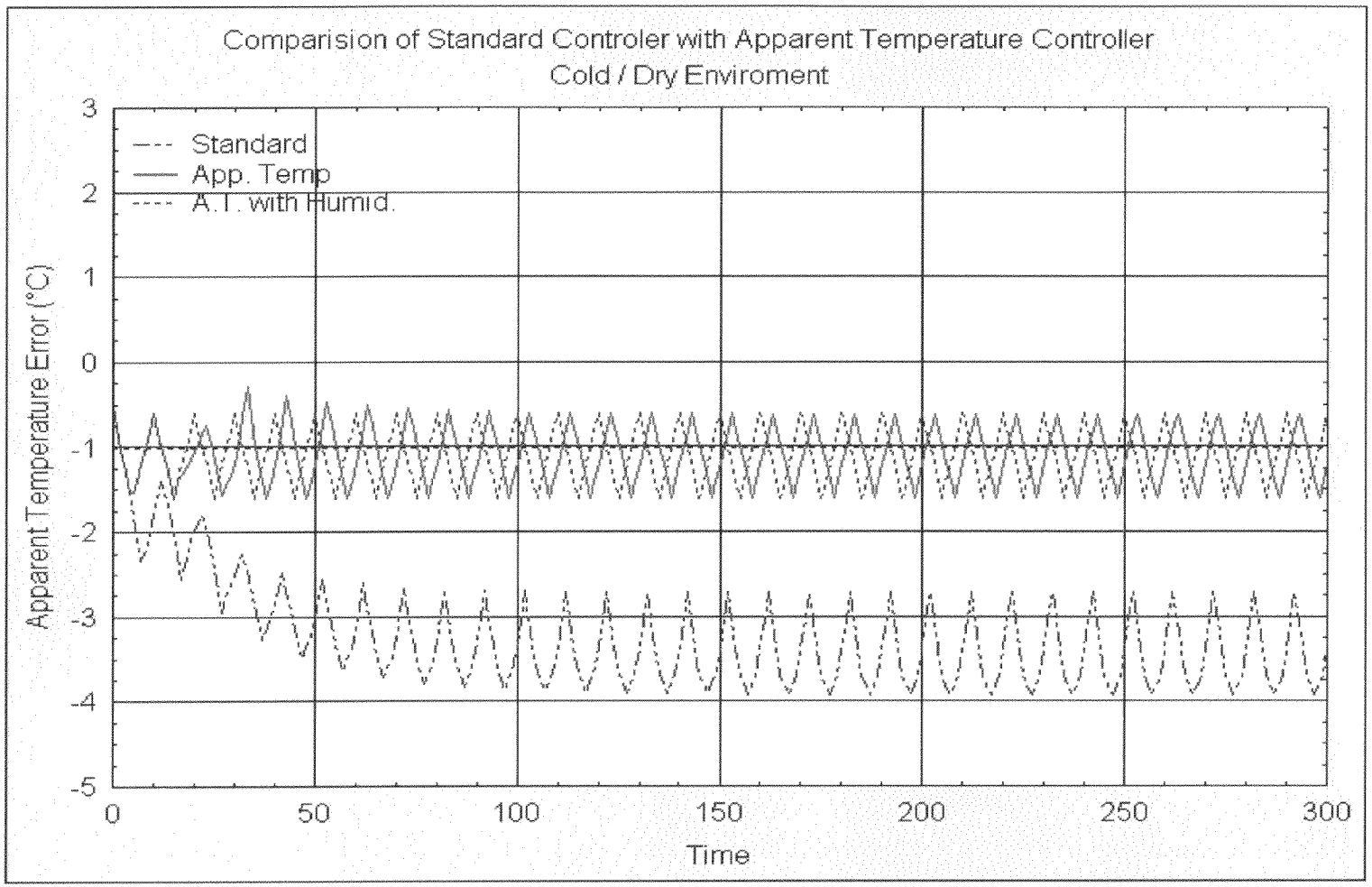

FIG. 7: Comparison of standard controller with apparent temperature controller for a cold/dry environment.

Figure 8:
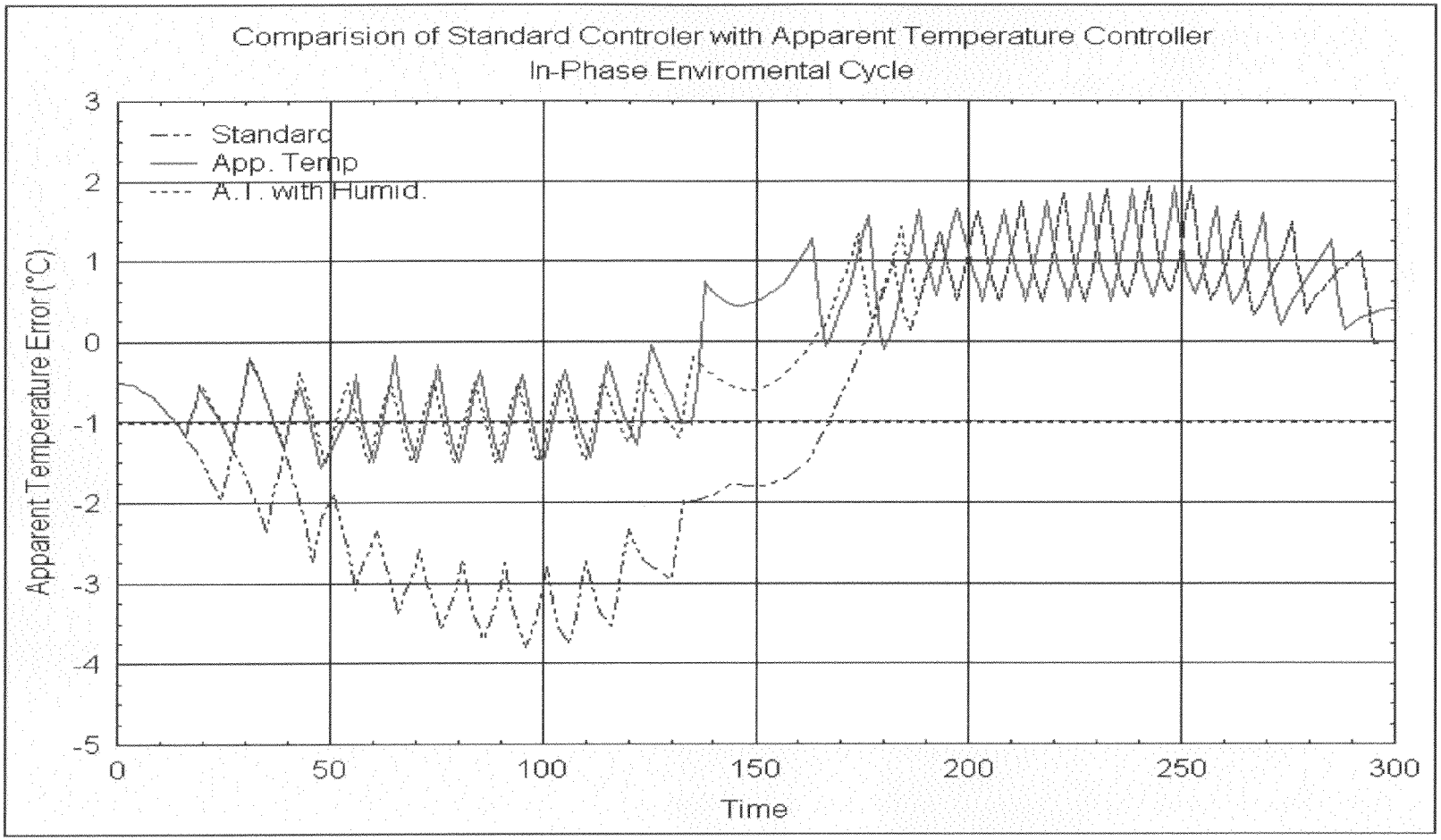

FIG. 8: Comparison of standard controller with apparent temperature controller for an in-phase environmental cycle.

Figure 9:
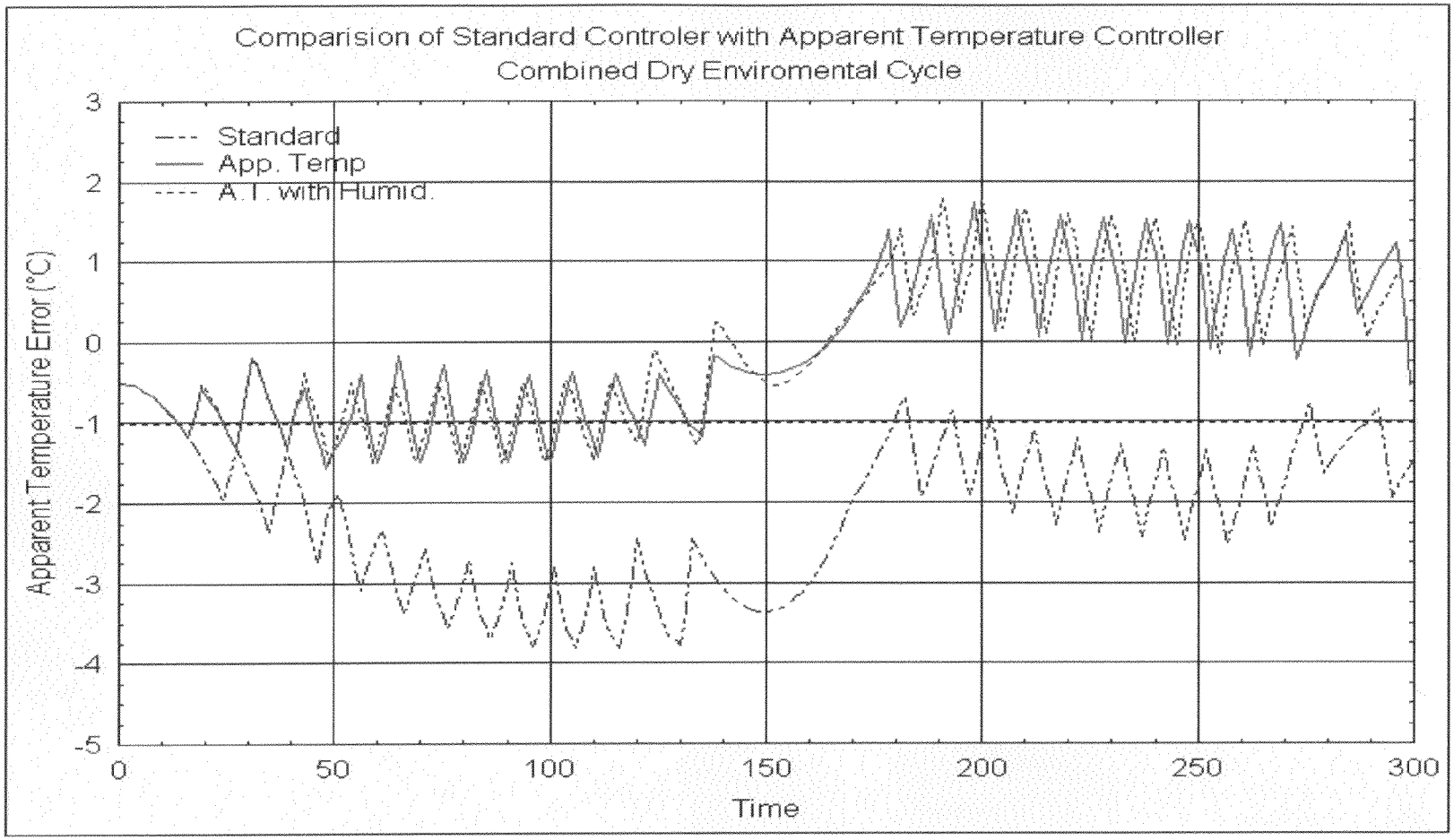

FIG. 9: Comparison of standard controller with apparent temperature controller for a combined dry environmental cycle.

Figure 10:
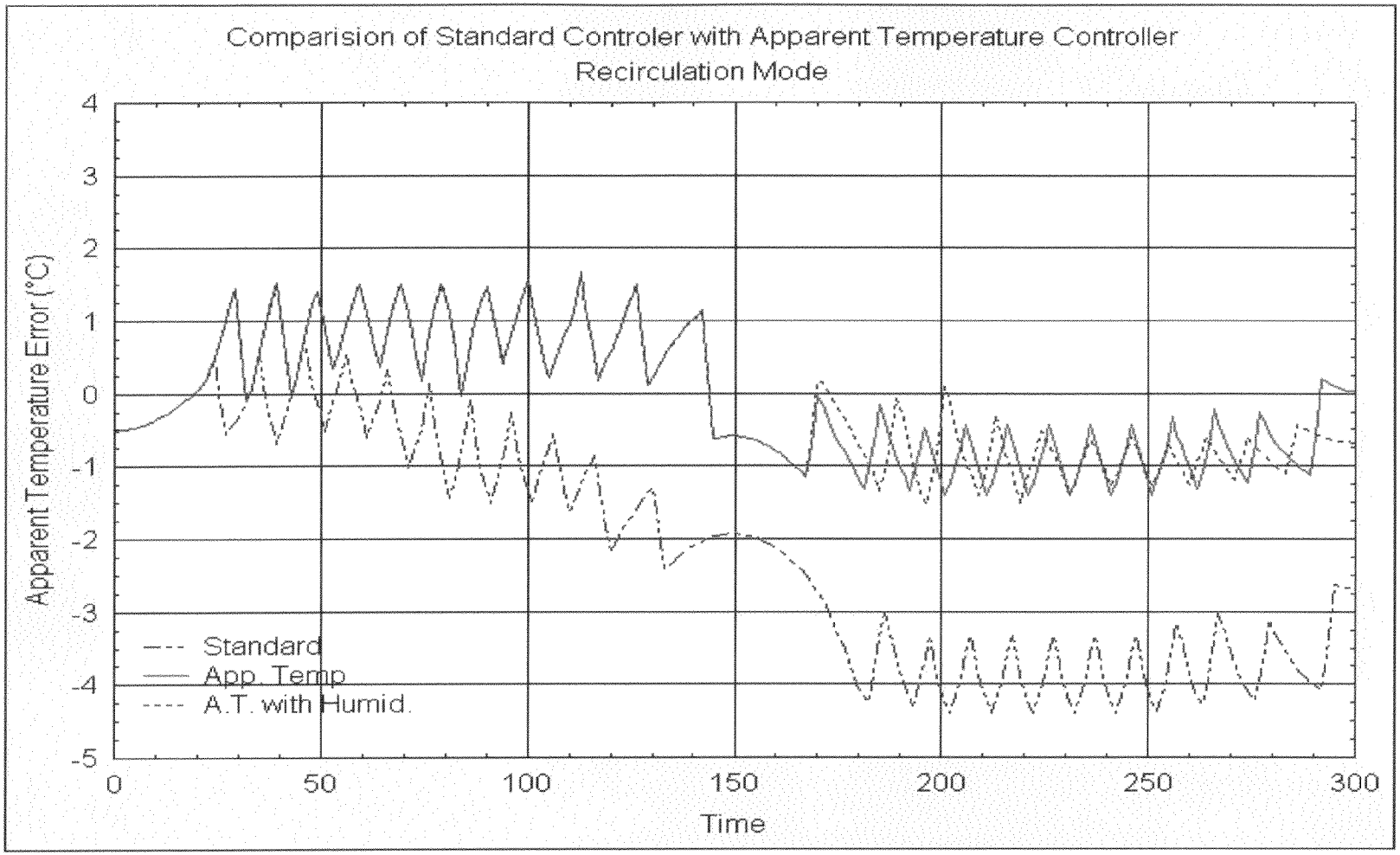

FIG. 10: Comparison of standard controller with apparent temperature controller for a recirculation mode environmental cycle.

DETAILED SUMMARY OF INVENTION

Inspecting the fit equations in FIG. 3 reveals that the slopes and offsets in these equations have a high correlation with the relative humidities. Thus the curves can be predicted from the relative humidity. The results of this model are shown in FIG. 4. Unfortunately, there is a fair spread in the predictions. Even worse, there is a divergence as the curves approach the HVAC control range implying that the model is unstable as a control function in the very region that is of interest for a HVAC control system.

I have previously used the concept of Available Moisture in conditioning of samples. This is the absolute moisture in the air at a given temperature and relative humidity as compared to some standard condition. For convenience I have used ASTM standards for textile testing although the choice affects only the magnitude of the constants in the solution. This concept is the basis of the data in Table 2. The effect on the model of using this variable as a parameter is shown in FIG. 5. As desired, the solution converges in the HVAC control region, providing a smooth control. As expected, the apparent temperature is a function only of the dry bulb temperature and the available moisture, which is related to the difference in the relative concentrations of water molecules in the air. This is to be expected as the relative concentration of water molecules in the air directly effects the evaporation of moisture from the skin and thus the natural cooling mechanism of the body. This approach allows a smooth control through the entire HVAC control range. It is essential to the proper operation of any controller that attempts to control to an apparent temperature that a solution converges in the HVAC control range so that the experimental data from Steadman may be reliably extrapolated to lower temperatures to cover the complete HVAC control range. This avoids having to "train" the system to comfort levels based on personal subjective perceptions.

Thus the HVAC Apparent Temperature Control System introduces a HVAC control system that controls to a perceived apparent temperature rather than a preset temperature. In the preferred embodiment, the desired apparent temperature is entered exactly as in current control systems. The control system then utilizes an algorithm similar to the one described to calculate the current effective temperature based on the current temperature and relative humidity. Alternatively, a look-up table based on this or a similar algorithm may be utilized to calculate the current effective temperature based on the current temperature and relative humidity. This is then compared to the desired apparent temperature for control purposes to maintain a constant comfort level.

As the control system operates and the environmental conditions change, the system continually utilizes the minimum amount of energy to maintain a constant comfort level. Of course such obvious control functions such as limiting the range of temperature modification could be implemented without losing a great deal of functionality and provide additional energy savings.

The addition of a humidification unit and control by the system, additional energy savings may be realized in the heating cycle by increasing the moisture in the air and thus maintaining the apparent temperature at a lower dry bulb temperature. In the preferred embodiment this would be an ultrasonic unit with UV sterilizer to reduce maintenance although evaporative, steam or other methods are also appreciative. It is not necessary to provide precise control of this humidification system, as the HVAC control system would automatically adjust for the performance of the humidity system.

The action of this control may be modeled reasonably accurately. The results for a standard on/off temperature HVAC controller with a +/−1° C. control limit is compared to an apparent temperature controller with the same control limits for a hot/dry environment in FIG. 6. Since the cooling cycle is on, moisture is removed from the air reducing the amount of required cooling to maintain a constant apparent temperature. As a result, note that the cooling cycle for the apparent temperature controller is on only 47.8% of the time as compared to 49.8% for the standard controller.

The results for a standard on/off temperature HVAC controller with a +/−1° C. control limit is compared to an apparent temperature controller with the same control limits for a cold/dry environment in FIG. 7. In this case the heating is on. The standard controller results in an unacceptable comfort level requiring the operator to increase the set point while the action is automatic for the apparent temperature controller. In this case, if the option of a humidifier is utilized, the percentage of time that the heating cycle is on drops from 51.2% to 50.2%

The results for a standard on/off temperature HVAC controller with a +/−1° C. control limit is compared to an apparent temperature controller with the same control limits for an in-phase environmental cycle in FIG. 8 and for a combined environmental dry cycle in FIG. 9. In both cases, the apparent temperature controller provides superior control.

The results for a standard on/off temperature HVAC controller with a +/−1° C. control limit is compared to an apparent temperature controller with the same control limits for a recirculation environmental cycle where the system is set to re-circulate the room air in FIG. 10. Again, the apparent temperature controller provides superior control as the cooling part of the cycle removes moisture from the air resulting in excess cooling (and excess energy usage) by the standard controller.

TABLE 1

Relative Humidity at Different Temperatures when Moisture in the Air is Held Constant

| Temperature | 17° C. | 20° C. | 23° C. |
|---|---|---|---|
| Moisture Level 1 | 66.3% | 55% | 45.8% |
| Moisture Level 2 | 78.4% | 65% | 54.1% |
| Moisture Level 3 | 90.4% | 75% | 62.4% |

TABLE 2

Moisture in Air at Different Temperatures and Relative Humidifies as Percentage of Moisture at 20° C. and 65% R.H.

| | 15° C. | 16° C. | 17° C. | 18° C. | 19° C. | 20° C. | 21° C. | 22° C. | 23° C. | 24° C. | 25° C. |
|---|---|---|---|---|---|---|---|---|---|---|---|
| 55% | 60.6 | 64.5 | 68.8 | 73.6 | 78.9 | 84.6 | 90.9 | 97.7 | 105.1 | 113.1 | 121.7 |
| 56% | 61.7 | 65.7 | 70.1 | 74.9 | 80.3 | 86.2 | 92.5 | 99.5 | 107.0 | 115.1 | 123.9 |
| 57% | 62.8 | 66.8 | 71.3 | 76.3 | 81.7 | 87.7 | 94.2 | 101.3 | 108.9 | 117.2 | 126.1 |
| 58% | 63.9 | 68.0 | 72.6 | 77.6 | 83.2 | 89.2 | 95.9 | 103.0 | 110.8 | 119.2 | 128.3 |
| 59% | 65.0 | 69.2 | 73.8 | 79.0 | 84.6 | 90.8 | 97.5 | 104.8 | 112.7 | 121.3 | 130.5 |
| 60% | 66.1 | 70.4 | 75.1 | 80.3 | 86.0 | 92.3 | 99.2 | 106.6 | 114.7 | 123.4 | 132.7 |
| 61% | 67.2 | 71.5 | 76.3 | 81.6 | 87.5 | 93.9 | 100.8 | 108.4 | 116.6 | 125.4 | 134.9 |
| 62% | 68.3 | 72.7 | 77.6 | 83.0 | 88.9 | 95.4 | 102.5 | 110.1 | 118.5 | 127.5 | 137.2 |
| 63% | 69.4 | 73.9 | 89.8 | 84.3 | 90.3 | 96.9 | 104.1 | 111.9 | 120.4 | 129.5 | 139.4 |
| 64% | 70.5 | 75.0 | 80.1 | 85.7 | 91.8 | 98.5 | 105.8 | 113.7 | 122.3 | 131.6 | 141.6 |
| 65% | 71.6 | 73.2 | 81.3 | 87.0 | 93.2 | 100.0 | 107.4 | 115.5 | 125.2 | 133.6 | 143.8 |
| 66% | 82.7 | 77.4 | 82.6 | 88.3 | 94.6 | 101.5 | 109.1 | 117.3 | 126.1 | 135.7 | 146.0 |
| 67% | 73.8 | 78.6 | 83.8 | 89.7 | 96.1 | 103.1 | 110.7 | 119.0 | 128.0 | 137.8 | 148.2 |
| 68% | 74.9 | 79.7 | 85.1 | 91.0 | 97.5 | 104.6 | 112.4 | 120.8 | 129.9 | 139.8 | 150.4 |
| 69% | 75.9 | 80.9 | 86.3 | 92.3 | 98.9 | 106.2 | 114.0 | 122.6 | 131.9 | 141.9 | 152.6 |
| 70% | 77.1 | 82.1 | 78.6 | 93.7 | 100.4 | 107.7 | 115.7 | 124.4 | 133.8 | 143.9 | 154.9 |
| 71% | 78.2 | 83.2 | 88.8 | 95.0 | 101.8 | 109.2 | 117.3 | 126.1 | 135.7 | 146.0 | 157.1 |
| 72% | 79.3 | 84.4 | 90.1 | 96.4 | 103.2 | 110.8 | 119.0 | 127.9 | 137.6 | 148.0 | 159.3 |
| 73% | 80.4 | 85.6 | 91.3 | 97.7 | 104.7 | 112.3 | 120.6 | 129.7 | 139.5 | 150.1 | 161.5 |
| 74% | 81.5 | 86.8 | 92.6 | 99.0 | 106.1 | 113.9 | 122.3 | 131.5 | 141.4 | 152.1 | 163.7 |
| 75% | 82.6 | 87.9 | 93.8 | 100.4 | 107.5 | 115.4 | 123.9 | 133.2 | 143.3 | 154.2 | 165.9 |

REF CITED

5170935, December 1992, Federspiel, Adaptable control of HVAC systems, United States (US)

557994, December 1996, Davis et al., Method and control system for adaptively controlling an automotive HVAC system based, United States (US)

5988517, November 1999, Bauer et al., Method and system for controlling an automotive HVAC system based on the principal of HVAC work, United States (US)

20030216838, November 2003, Dudley, Location adjusted HVAC system, United States (US)

6173902, January 2001, Bauer et al., Method and system for controlling an automotive HVAC system based on the principal of HVAC work, United States (US)

Humidity and Predicted-Mean-Vote-Based Comfort Control, J. W. MacArthur, ASHRAE Transactions, Vol. 92, Part 1B, pp. 5-17, 1986

The Development of PMV-Based Control for a Residence in a Hot Arid Climate, D. G. Scheatzle, ASHRAE Transactions, vol. 97, Part 2.

HVAC Control Modeling, Claude Roger Riley Jr., March 2008, unpublished document,

What is claimed is:

1. An HVAC control system to control a heating system and a cooling system in order to adjust apparent temperature to a desired apparent temperature, comprising:

a temperature sensor to obtain an air temperature measurement and to generate a dry bulb temperature value from the air temperature measurement;

a humidity sensor to obtain a humidity measurement and to generate a relative humidity value from the humidity measurement;

an input interface to receive a desired apparent temperature value from a user;

a controller to control the heating system and the cooling system, said controller in communication with the heating system, said controller in communication with the cooling system, said controller to receive the dry bulb temperature value from said temperature sensor, said controller to receive the relative humidity value from said humidity sensor, said controller to receive the desired apparent temperature value from said input interface, said controller to calculate a current effective temperature value based on the dry bulb temperature value and the relative humidity value, wherein said controller calculates the current effective temperature value through an algorithm that generates effective temperature values as outputs of a function that uses dry bulb temperature values and the relative humidity values as inputs, said controller to calculate a target temperature value based on the current effective temperature value, the dry bulb temperature value, the relative humidity value, the desired apparent temperature value, and said algorithm, such that adjusting the dry bulb temperature value to the target temperature value yields the desired apparent temperature value according to said algorithm, said controller to activate the heating system if the target temperature value is greater than the dry bulb temperature value, said controller to activate the cooling system if the target temperature value is less than the dry bulb temperature value.

2. The HVAC control system of claim 1 further comprising a humidifier to add moisture to the air, whereby the HVAC system maintains a constant apparent temperature with a lower dry bulb temperature value.

3. A method for controlling apparent temperature, comprising:

supplying a controller in communication with a heating system and a cooling system;

obtaining a measured dry bulb temperature value and communicating the measured dry bulb temperature value to said controller;

obtaining a measured moisture value and communicating the measured moisture value to said controller;

supplying a desired apparent temperature value to said controller;

using said controller to calculate a current apparent temperature value based on the measured dry bulb temperature value and the measured moisture value, said current effective temperature value being calculated based on comparison of the measured dry bulb temperature value and measured moisture value to a table of apparent temperature values correlated to dry bulb temperature values and measured moisture values, said table of apparent temperature values correlated to dry bulb temperature values and measured moisture values including dry bulb temperature values between 15 degrees Celsius and 30 degrees Celsius, wherein each observed combination of dry bulb temperature value and measured moisture value constitutes a data-point-pair, and wherein each data-point-pair is correlated to one apparent temperature value, so that identifying the data-point-pair with dry bulb temperature and moisture value closest to the measured dry bulb temperature value and the measured moisture value yields a value for the current apparent temperature;

using said controller to calculate a target temperature value based on the current effective temperature value, the dry bulb temperature value, the moisture value, the desired apparent temperature value, and said table of apparent temperature values correlated to dry bulb temperature values and measured moisture values, such that adjusting the dry bulb temperature value to the target temperature value yields the desired apparent temperature value according to said table;

activating the heating system if the target temperature value is greater than the measured dry bulb temperature value; and activating the cooling system if the target temperature value is less than the measured dry bulb temperature value.

* * * * *